United States Patent [19]

Hashimoto et al.

[11] 4,358,210

[45] Nov. 9, 1982

[54] MECHANICAL PENCIL WITH CHUCK CLOSING BY NORMAL WRITING GRIP

[75] Inventors: Yasuyuki Hashimoto, Nishinomiya; Osamu Torii, Kyoto, both of Japan

[73] Assignee: Ancos Co., Ltd., Osaka, Japan

[21] Appl. No.: 94,263

[22] Filed: Nov. 14, 1979

[30] Foreign Application Priority Data

Nov. 20, 1978 [JP] Japan ..... 53-142267
Jul. 30, 1979 [JP] Japan ..... 54-104174

[51] Int. Cl.[3] ..... B43K 21/22; B43K 24/10

[52] U.S. Cl. ..... 401/65; 401/62; 401/67; 401/80; 401/82; 401/93; 401/94

[58] Field of Search ..... 401/65, 67, 92–94, 401/82, 62, 77, 80, 65, 93, 99

[56] References Cited

U.S. PATENT DOCUMENTS

| | | | |
|---|---|---|---|
| 223,498 | 1/1880 | Fraser | 401/94 X |
| 1,447,677 | 3/1923 | Lindberg | 401/67 |
| 1,518,822 | 12/1924 | Saadi | 401/77 X |
| 1,595,150 | 8/1926 | Greening | 401/62 |
| 2,340,665 | 1/1944 | Jacobs | 401/65 |
| 3,883,253 | 5/1975 | Naruse et al. | 401/92 X |
| 4,149,813 | 4/1979 | Katz | 401/67 X |
| 4,270,870 | 6/1981 | Hashimoto et al. | 401/93 |

FOREIGN PATENT DOCUMENTS

| | | | |
|---|---|---|---|
| 452723 | 6/1926 | Fed. Rep. of Germany | 401/82 |
| 2821625 | 11/1978 | Fed. Rep. of Germany | 401/67 |
| 15187 | 12/1885 | United Kingdom | 401/94 |

*Primary Examiner*—Steven A. Bratlie
*Attorney, Agent, or Firm*—Sughrue, Mion, Zinn, Macpeak & Seas

[57] ABSTRACT

A mechanical pencil in which the lead is advanced by squeezing a cylindrical depression member provided at the position of the writer's fingers during normal writing operations. The pencil includes a hollow body with front and rear axial sleeves. A chuck is disposed within the pencil body which has a resiliency which urges the chuck to open outwardly at the front end thereof. A slider including a lead holding member for lightly holding the lead is slidably positioned at the tip of the front axial sleeve. Means is provided for transmitting movement from the depression member, which is formed of a resilient material flush with the cylindrical surface of the pencil body, for transmitting movement from the depression member to the chuck. A lead casing means is disposed in the rear axial sleeve which in some embodiments has the dual function of transmitting movement from a push button provided at the rear of the pencil to the chuck for advancing the lead in a conventional manner.

1 Claim, 27 Drawing Figures

MECHANICAL PENCIL WITH CHUCK CLOSING BY NORMAL WRITING GRIP

BACKGROUND OF THE INVENTION

The present invention relates to a mechanical pencil capable of feeding new lead by utilizing only the natural force applied thereto when the pencil is gripped during writing.

There have been heretofore provided mechanical pencils having various lead feeding mechanisms, each having inherent deficiencies or drawbacks. For example, in one type in which lead is fed by rotating an axial body of the pencil, both hands are required for the operation and the length of the newly fed lead is not held constant when writing. Also in this type, the lead may easily be broken. Accordingly, such a mechanical pencil is unsuitable for use with thin lead and is now seldom used.

In another type of pencil, a push rod extending from the rear axial body of a mechanical pencil is pressed or tapped to thereby feed a new lead. Although advantageous in that the feeding length of the lead is constant and only one hand is required for feeding the lead, it is disadvantageous in that the gripping form of the hand is changed each time lead is fed.

In a so-called side feeding type where a lead is fed by pushing a single feed plate provided at the finger gripping part, since another finger of the same hand must support the opposite position of the knock plate. Unfortunately the finger gripping form of such a pencil feels unnatural and it is very difficult to perform the feeding operation.

In a mechanical pencil type where an axial body per se is deformed at an obtuse angle to feed a new lead, since an unnatural force must be used to feed the lead, it is very difficult to use.

In a so-called tip end feeding type where a front tip of a mechanical pencil is pushed against a paper or the like, a counter part to which the lead or the tip pipe holding it is held in abutment is required. If the counter part is soft, it is difficult to carry out the feeding operation and the counter part may be damaged or undesirably marked.

In order to eliminate the above-noted defects, an object of the present invention is to provide a novel mechanical pencil in which the natural force used in gripping the axial body of the pencil during the normal writing operation can be utilized for feeding new lead.

SUMMARY OF THE INVENTION

This as well as other objects of the invention, are met by a mechanical pencil including a hollow pencil body including a front axial sleeve having a generally conically shaped portion and a rear axial sleeve having a generally cylindrical shape, a chuck disposed within the pencil body and having a resiliency which urges the chuck to open outwardly at a front end portion thereof with the chuck grasping a lead when tightened, a slider including a lead holding member for lightly holding the lead with the slider being slidable at a tip of the front axial sleeve and with the slider including a shoulder portion positioned within the front axial sleeve for limiting the range of movement of the slider, a generally cylindrical resilient depression member one end of which is coupled to the portion of the pencil body with the depression member positioned at a position within the body normally in contact with the writer's fingers during writing with the pencil, means for transmitting movement due to deformation of the depression member to the chuck, and lead casing means disposed within the rear axial sleeve of the pencil body.

In one embodiment, the lead casing means is formed as a cylindrical lead casing rigidly coupled to a rear end portion of the chuck. A spring is provided for rearwardly biasing the chuck and casing. The transmission means in this embodiment includes a first chuck tightening member surrounding at least a portion of the chuck and a ring member in contact with the tightening member secured to a rear free end portion of the depression member with a front end portion of the tightening member contacting a front outer slanted portion of the chuck so as to transmit a movement of the depression member due to its deformation to the chuck whereby the chuck tightening member is advanced to positively grip the chuck. An additional lead feeding mechanism can be provided. This may include a push button extending outwardly axially from a rear end of the rear axial sleeve for manual depression and a longitudinal rod in contact with one end of the push button and at the other end with the rear end of the chuck tightening member.

In accordance with another embodiment, the lead casing means includes a cylindrical lead casing coupled to a rear end of the chuck. The transmission means includes a first chuck tightening member surrounding at least a portion of the chuck and a ring member a rear end of which is in contact with the first chuck tightening member. The ring member is secured to a rear free end portion of the depression member and a front end portion of the chuck tightening member contacts a front outer slanted portion of the chuck. There is also provided a second chuck tightening member, a front end portion of which is in contact with the front end portion of the chuck and a spring for biasing the second chuck tightening member rearwardly within the first axial sleeve whereby the first and second chuck members are advanced to grip the chuck. As in the previous embodiment, there may also be provided an additional lead feeding mechanism including a push button in contact with a rear portion of the lead casing.

Also in accordance with the invention, a rear end portion of the chuck is slidably positioned in the rear axial sleeve and the transmission means includes a ring member secured to a free end of the depression member and a first tightening member one end of which is in contact with the ring member. A front end portion of the first tightening member contacts a front outer slanted portion of the chuck and a second chuck tightening member is positioned substantially within the front axial sleeve in contact with the front end portion of the chuck whereby the first and second chuck tightening members urge the chuck to a closed position to grip the lead.

In accordance with another aspect of the invention a rear end portion of the chuck is slidably positioned in the rear axial sleeve. There is then further included a ring member secured to a free end of the depression member. The transmission means includes in this case a push member one end of which is in contact with the ring member and with a front end portion contacting a front outer vertical portion of the chuck. A second chuck tightening member is positioned in the inner periphery of the front axial sleeve in contact with a front outer slanted portion of the chuck whereby the chuck tightening member and the push member urge the chuck to a closed position to thereby grip the lead.

Still further, the lead casing means may comprise a cylindrical lead casing coupled to a rear end of the chuck. In this embodiment, the transmission means includes a first spring and a tightening member extending to the front end of the rear axial sleeve and which is biased rearwardly by the first spring so as to abut against the rear inner end of the rear axial sleeve. A front end of the first tightening member contacts a front slanted portion of the chuck. A second spring and a push member contact a front end surface of the chuck with the push member biased rearwardly within the front axial body by the second spring. The depression member is coupled to the front axial sleeve at one end thereof and is coupled at its other end to the rear axial sleeve. The depression member is shortened in length when depressed whereby the front axial sleeve is moved rearwardly in response to depression of the depressing member to thereby feed new lead. An additional lead feeding mechanism can be provided in this embodiment including a push button extending axially outward from the rear end of the rear axial sleeve and the tightening member having a rear end in contact with the push button and a front end abutting the rear end of a flared portion of the chuck at the front end of the chuck.

In still another embodiment, the lead casing is coupled rigidly to the chuck and the transmission means includes a first chuck tightening member coupled to the rear axial sleeve, a spring positioned within the front axial body, and a second chuck tightening member biased backwardly by the spring. The second chuck tightening member is positioned in abutment with a front slanted portion of the chuck. The depression member is coupled to the front axial sleeve at one end thereof and coupled to the rear axial sleeve at its other end. The depression member is shortened in length when depressed whereby the front axial sleeve is moved rearwardly to thereby feed new lead.

And a further embodiment, the transmission means includes a second tightening member in abutment with a front slanted portion of the chuck and the depression member is connected to the rear axial sleeve at one end thereof and to the second tightening member at a front end thereof. The front and rear axial sleeves are connected rigidly with one another.

Still further, the transmission means may include a first spring and a second spring, and a first tightening member in contacting at a front end a front slanted portion of the chuck. The lead casing is biased backwardly by the first spring. The chuck is biased backwardly by the second spring. Ball bearing means is positioned between a front portion of the depression member and a portion of the first tightening member. The depression member is provided with hinged portions for elongating the length of the depression member. In this embodiment, a slider retaining means may be provided within the front axial sleeve for retaining the slider within the front axial sleeve. Also, an additional lead feeding mechanism may be provided including a push rod having one end thereof in abutment with a rear end of the lead casing.

In a yet further embodiment, cam means may be provided at a rear free end of the depression member. In this embodiment, the transmission means includes a spring and the lead casing means has a cam means associated with the cam means of the depression member and which is biased forwardly by the spring. The chuck member is coupled to the lead casing means and a tightening member for closing the chuck and a bearing means is provided between the chuck and the tightening member whereby the lead is gripped when the depression member is depressed. In this embodiment, an additional lead feeding mechanism may include a push rod connected at one end thereof to a rear end of the lead casing means.

In a final embodiment, the depression member includes hinged portions and the depression member is fixedly connected to the front and rear axial sleeves at its front and rear ends, respectively. The lead casing means in this embodiment is coupled to the chuck and there is further provided a tightening member coupled to the rear axial body. Ball bearing means is provided between the chuck and the tightening member and a spring for biasing the chuck backwardly when the depression member is depressed.

de

DESCRIPTION OF THE PREFERRED EMBODIMENTS

Figure 1:
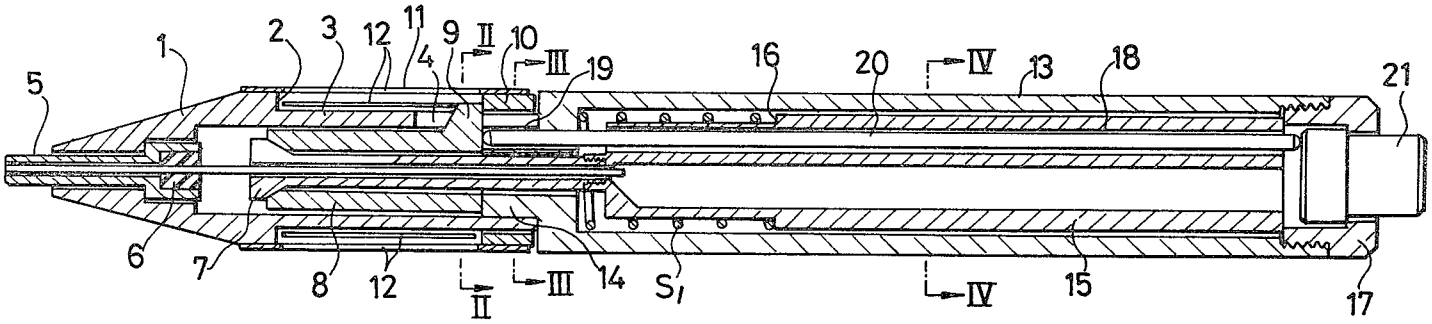
FIG. 1 is a cross-sectional view of a mechanical pencil of a first embodiment of the invention.
Figure 4:
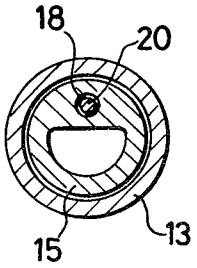
FIG. 4 is a cross-sectional view of the mechanical pencil taken along the line IV—IV of FIG. 1.
Figure 3:
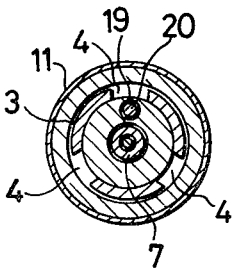
FIG. 3 is a cross-sectional view of the mechanical pencil taken along the line III—III of FIG. 1.
Figure 2:
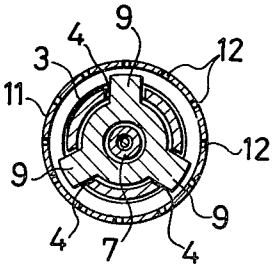
FIG. 2 is a cross-sectional view of the mechanical pencil taken along the line II—II of FIG. 1.

With reference to the embodiment of the invention shown in FIGS. 1–6, a front axial sleeve 1 includes a shouldered portion 2 and a small diameter portion 3.

Three slits 4 are formed at a rear end of the axial sleeve 1 equidistantly in its circumference.

A slider pipe 5 is slidably provided in a front portion of the axial sleeve 1. A front portion of the slider 5 is retractable into the body and projectable from the body. A lead holding member 6 is provided in the slider 5. The lead holding member 6 is made of elastic material such as rubber or synthetic resin in order to lightly hold the lead therein at all times.

A chuck 7 biased is an open position due to its resiliency is inserted into the rear of the front axial sleeve 1. A chuck tightening member 8 is provided on the outer periphery of the chuck 7. Three equidistant projections 9 which are engaged with the slits 4 in the axial sleeve are formed on the outer periphery of the tightening member 8. Each of the projections 9 extends slightly above the small diameter portion 3 of the front axial sleeve 1. A stopper ring 10 is provided at the rear end of the small diameter portion 3 and is positioned behind the projections 9. A generally cylindrical depression member 11 is provided on the outer periphery of the front axial sleeve 1 with a front end of the depression member fixedly secured to the front outer periphery of the sleeve and the rear end thereof to the outer periphery of the stopper ring 10. A plurality of slits 12 are equidistantly formed in the axial direction in the depression member 11. The depression member 11 is made of metal, plastics or the like. The mid-portion thereof is deformable inwardly by a depressing force. When the force is released, the depression member 11 is restored to the original shape. It is desirable that the depression member 11 be made of highly flexible and durable material.

A small diameter portion 14 of a rear axial sleeve 13 is inserted into the small diameter portion of the front axial sleeve so that the front and rear axial sleeves 1 and 13 are fixedly engaged with each other. The body of the mechanical pencil is made up of the front and rear axial sleeves. The rear end of the chuck 7 is threadedly engaged with a front end of a lead casing 15 which is enclosed in the rear axial sleeve 13. A shouldered portion 16 is formed at an outer intermediate portion of the lead casing 15. A spring $S_1$ is disposed between the shouldered portion 16 and an inner end portion of the rear axial sleeve 13 to thereby urge the lead casing 15 rearwardly with a rear end of the lead casing 15 abutting against a cap member 17. A through hole 18 is formed in the lead casing 15 in the axial direction and also a through hole 19 is formed in the rear axial sleeve 13 in the axial direction so that a single long rod 20 passes therethrough. The rod 20 abuts at a front end to the rear end of the tightening member 8 and at a rear end to a front end of pushbutton member 21 which is inserted into the cap member 17.

In operation, when no force is applied to the mechanical pencil, the chuck 7 is retracted through the lead casing 15 by the spring $S_1$ while the rear end of the casing 15 is supported by the cap member. Therefore, the chuck 7 is disengaged from the tightening member 8 so that it neither retains nor holds the lead. If the mechanical pencil is, in this state, carried with the tip end directed upward, the slider 5 is automatically received into the body to lower the slider due to its gravitational force.

Figure 5:
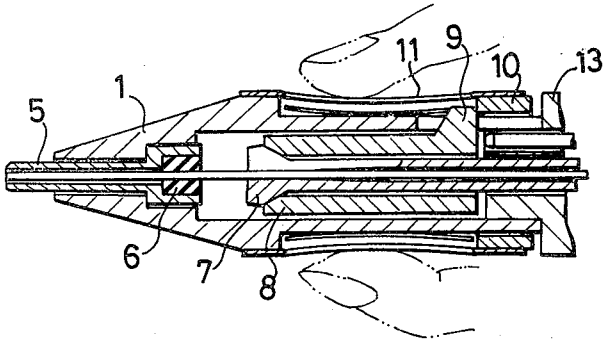

In the writing state, the tip end of the mechanical pencil is directed downward. In this case, the slider 5 is advanced together with the lead as shown in FIG. 1. When the depression member 11 is pushed inwardly in the state shown in FIG. 1, the axial length of the depression member 11 is shortened to thereby advance slightly the ring 10. When the ring 10 is advanced, so do the projections 9 of the tightening member 8 to thereby advance the tightening member 8. Since the chuck 7 is retracted by the spring $S_1$, when the tightening member 8 is advanced to tighten the chuck 7, the lead is held by the chuck 7 as shown in FIG. 5. In this state, when the writing continues and as the lead is worn down, the slider 5 is retracted. It is of course possible to continue the writing until the slider 5 is fully retracted in this state. However, it is quite general that in writing the writing is intermittently ceased such as for the purpose of relaxing the writer's finger. The depression member 11 is restored to its original shape due to its flexibility without the retaining force as soon as the gripping force has been released. The tightening member 8 releases the chuck 7 to also release the lead. At the instant when the lead is released, the slider 5 is advanced with the lead holding member 6 together with the lead due to gravitational forces returning to the state shown in FIG. 1.

Writing may continue while the depression member 11 is pushed inwardly. Once the depression member 11 is released, a new lead is automatically fed.

Figure 6:
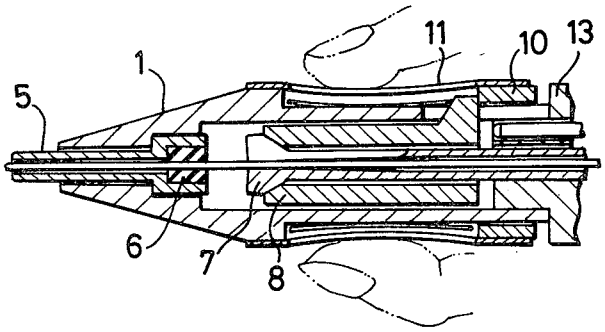
FIGS. 5 and 6 are cross-sectional views of portions of FIG. 1 showing successive operational states of the mechanical pencil shown in FIG. 1.

In addition, in the mechanical pencil of the invention, any desired length of new lead can be freely fed from the end of the slider 5. In order to supply the lead, a much greater force is applied to the depression member 11 shown in FIG. 5 and as a result the depression member 11 becomes as shown in FIG. 6. In this case, the push plate is much more retracted and the ring 10 is also further advanced to push the tightening member 8. Accordingly, the chuck 7 is further advanced while retaining the lead to thereby feed a new lead from the front end of the slider 5. The lead may be further advanced by repeating the operations from FIG. 1 to FIG. 6.

Figure 7:
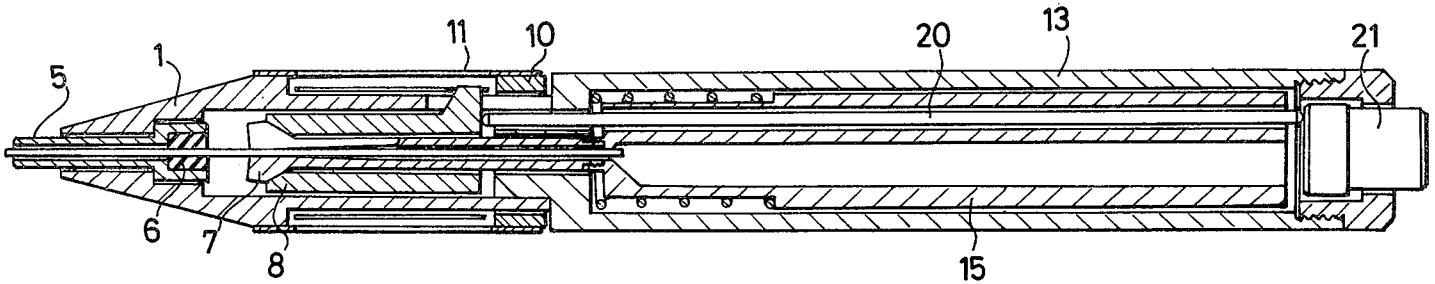
FIG. 7 is a cross-sectional view of an embodiment of the mechanical pencil in which a push rod is used.

It is possible to operate the mechanical pencil in the same manner as an ordinary pushbutton-type mechanical pencil. This operation will be described with reference to FIG. 7. When the pushbutton member 21 is depressed, the tightening member 8 is advanced through the rod 20. Other operations of the mechanical pencil are the same as described above. It should be noted that since the rod 20 directly pushes the tightening member 8, the ring 10 is not advanced and therefore the depression member 11 is not deformed. Furthermore, in order to initially supply to the end of the slider 5 a new lead which was stored in the lead casing 15, the pushbutton member is preferrably depressed rather than the depression member 11 as it more quickly advances the lead.

Figure 8:
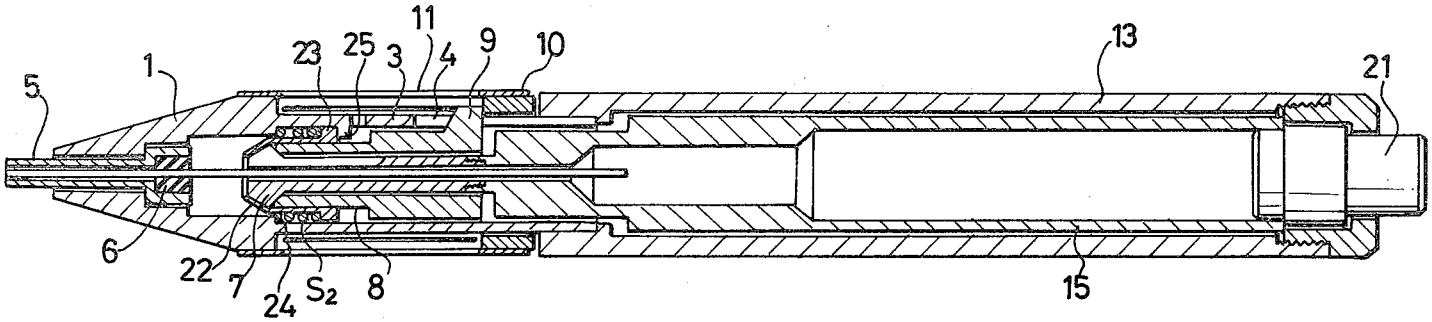
FIGS. 8 to 14 are cross-sectional views of mechanical pencil of second to eighth embodiments according to the present invention.

FIG. 8 shows a second embodiment according to the present invention in which tightening members are provided in front of and behind the chuck 7, respectively. That is, in addition to the tightening member 8 of the first embodiment, another tightening member 22 is provided in front of the chuck 7. The tightening member 22 is tapered forwardly in the form of a cylinder and has a flanged portion 23 at the rear end thereof. A spring $S_2$ is disposed between the flanged portion 23 and a shouldered portion 24 formed in the inner periphery of the front axial body 1 so that the tightening member 22 is urged backwardly. A stopper 25 is formed on the small diameter portion 3 so that the tightening member 22 is prevented from moving therebeyond. In the second embodiment the longitudinal rod 20 in the previous embodiment is not used and instead, when the pushbutton member 21 is depressed, the chuck 7 is moved through movement of the lead casing 15. Other mechanisms of the second embodiment are the same as the first embodiment.

In the second embodiment, since by the depression of the depression member 11 the tightening member 8 is advanced to tighten the chuck 7 against the front tightening member 22, it is possible to positively grip the lead with only a weak pressure applied to the depression member 11. In case that the pushbutton member 21 is activated, the chuck 7 is pushed through the lead casing 15 and therefore the chuck 7 is tightened by the front tightening member 22 to thereby grip the lead. In this case, the rear tightening member 8 is inoperative. Accordingly, if the rear end of the depression member 11 is directly coupled to the projections 9, the ring 10 can be dispensed with. Also in the second embodiment, it is possible to feed a lead in the same manner as the first embodiment.

Figure 9:
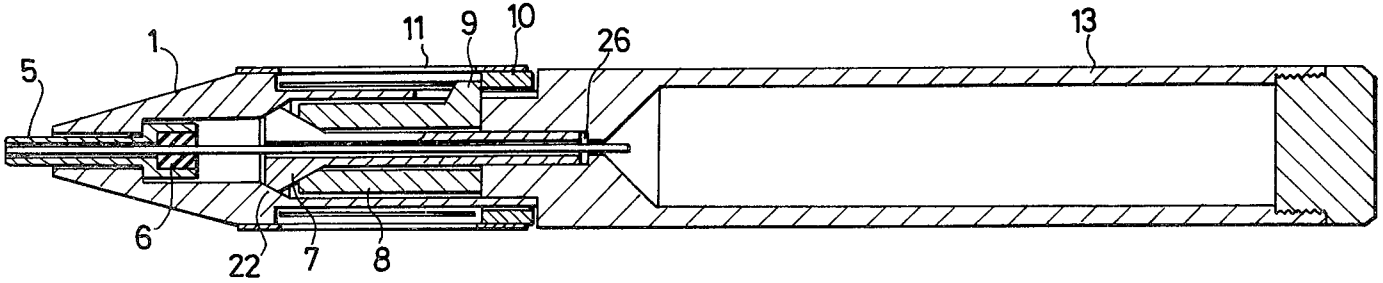

FIG. 9 shows a third embodiment according to the present invention in which the front tightening member 22 is integrally formed with the inner surface of the front axial body 1. A separate lead casing is not provided but instead the rear axial body 13 has a reservoir formed therein. The chuck 7 is reciprocatingly movable since the rear end portion of the chuck 7 is slidably insertable into the axial hole 26 formed in the rear axial body 13. When the depression member 11 is depressed, the rear tightening member 8 is advanced to tighten the chuck 7 against the front tightening member 22. In the third embodiment, even if the tightening member 8 is advanced, it is impossible to feed a lead from the tip end of the slider 5.

Figure 10:
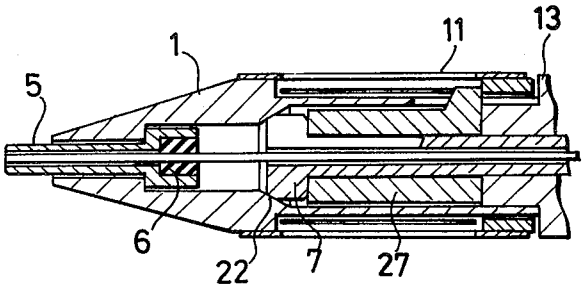

FIG. 10 shows a fourth embodiment of the present invention. The fourth embodiment is substantially similar to the third embodiment except that the tightening member 8 has been replaced by a push member 27 having a squared-off front end portion. In the fourth embodiment, when the depression member 11 is depressed, the push member 27 advances pushing the chuck 7. The chuck is tightened by the front chuck member 22.

In addition, in the fourth embodiment, when the depression plate is depressed, the chuck 7 may be advanced without the pushing member 27 by a suitable transmission means which is adapted to connect the rear end of the depression member 11 to the chuck 7. In case where the lead casing 15 is connected integrally with the rear end of the chuck 7, such a transmission means may be interposed between the rear end of the depression member 11 and the lead casing 15 so that the chuck 7 can be advanced through the transmission means and the lead case 15 by depression of the depression member 11.

Figure 11:
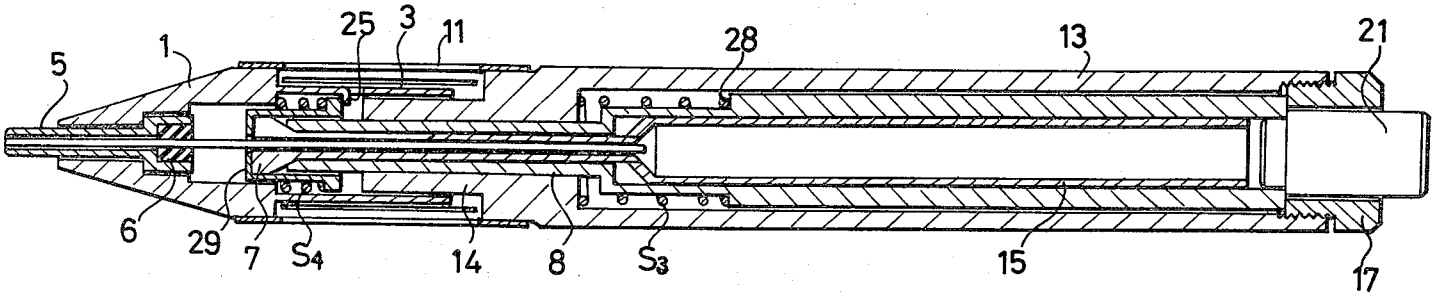

FIG. 11 shows the fifth embodiment according to the present invention in which when the depression member 11 is depressed, the front axial body 1 is moved rearward so that the overall length of the mechanical pencil is shortened. That is, the front axial body 1 can be moved fore and aft by slidably inserting a small diameter portion 14 of the rear axial body into the small diameter portion 3 of the front axial sleeve. Without the fastening ring 10, the rear end of the depression member 11 is fixed in the vicinity of the outer end of the rear axial body 13. The tightening member 8 arranged behind the chuck 7 is enlarged on the rear side and the enlarged portion thereof encloses a lead casing 15. The rear end of the tightening member 8 is in abutment with the cap member 17. The tightening member 8 is urged backward by the spring $S_3$ disposed between a shouldered portion formed in the outer periphery of the tightening member 8 and a shouldered portion formed in the front inner periphery of the rear axial body 13. The lead casing 15 is integral with the chuck 15. A push member 29 urged backwardly by a spring $S_4$ is provided in front of the chuck 7. The rear end of the push member is in abutment with a stopper 25 extending inwardly from the small diameter portion of the front axial body 1.

In the fifth embodiment, when the depression member 11 is depressed, the front axial body 1 is moved rearwardly and the push member 29 is moved rearwardly through the spring $S_4$. The push member 29 pushes the front surface of the chuck 7, and then the lead is gripped by the tightening member 8 which is prevented from moving backwardly due to the fixed cap member 17. Thereafter, the depression member 11 is further depressed to thereby feed a lead from the tip end of the slider 5. On the other hand, when the pushbutton member 21 is depressed, the tightening member 8 is advanced to tighten the chuck 7 whose forward movement is limited by the push member 29. In this case, the pushbutton member may be further depressed so that the lead can be provided from the tip of the slide 5.

Figure 12:
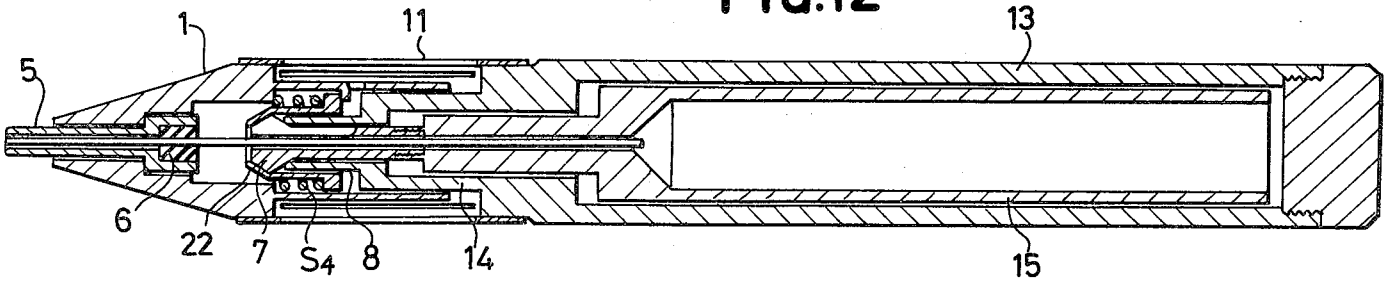

FIG. 12 shows a sixth embodiment according to the present invention. The sixth embodiment is substantially similar to the sixth embodiment. However, in the fifth embodiment, two tightening members are used and pushbutton operation is not possible. That is, in this embodiment, the push member is not provided in front of the chuck. The tightening member 22 and the rear tightening member 8 are fixedly mounted integrally on the small diameter portion 14 of the rear axial body 13. The rear end of the chuck 7 is coupled to the lead casing 15 which are thus movable together. Operation of the sixth embodiment is readily understood from the above description.

In the fifth and sixth embodiments, respectively, shown in FIGS. 11 and 12, when the depression member is depressed for writing, the chuck is moved rearwardly to grip the lead. In writing, the lead tends to be moved backwardly due to the writing pressure applied to the end of the lead. As a result, the chuck functions as a wedge which is inserted into the tightening member whereas the resultant writing pressure applied to the tightening member in the axial direction is directly transmitted to the pencil body without transmission through the depression member. Accordingly, only a minimal force need be applied to the depression member. This is one of the significant features of these embodiments.

Figure 13:
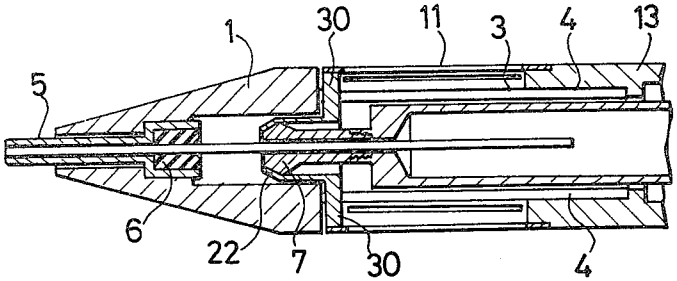

FIG. 13 shows a seventh embodiment of the present invention, in which when the depression member 11 is depressed the tightening member 22 provided in front of the chuck 7 is moved rearwardly for tightening the chuck 7. The small diameter portion 3 is inserted into the front inner portion of the rear axial body 13 to thereby connect one to the other. The front end portion of the depression member 11 is fixed to outer end surfaces of legs 30 extending radially from the rear part of the tightening member 22 after the legs are disengaged from the respective slits 4 formed in the small diameter portion 3.

Figure 14:
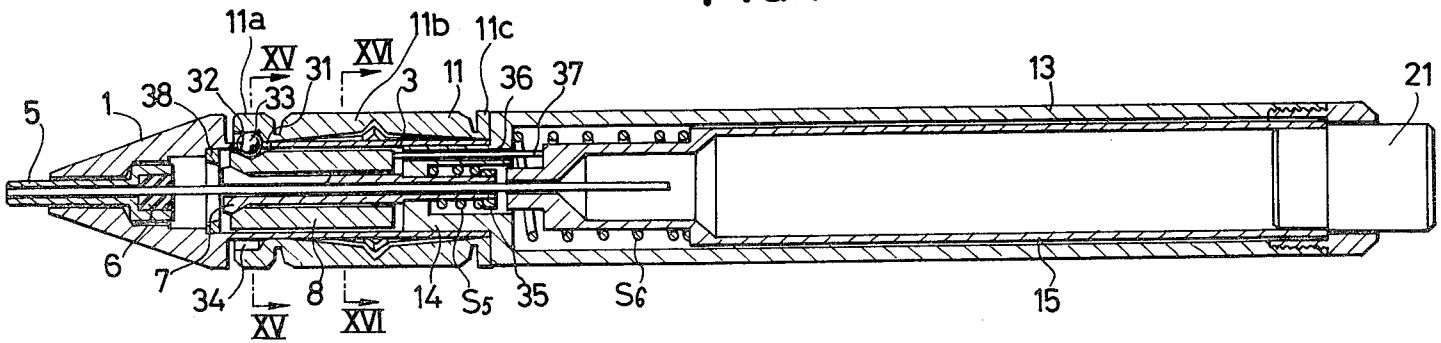
Figure 16:
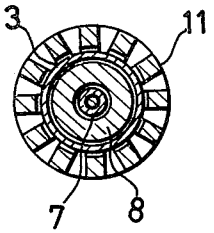
FIGS. 15 to 16 are cross-sectional views of the mechanical pencil taken along the lines XV—XV and XVI—XVI, respectively, of FIG. 14.
Figure 15:
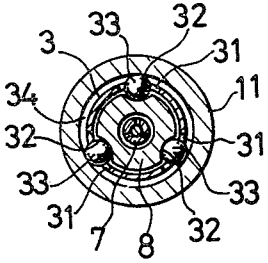

FIGS. 14 to 16 inclusive show an eighth embodiment of the present invention. FIGS. 15 and 16 are cross-sectional views taken along the lines XV—XV and XVI- —XVI of FIG. 14, respectively. In the eighth embodiment, the depression member 11 is modified. That is, hinge portions are formed in the material connecting between a front annular ring 11*a* and a midportion 11*b* and between a rear annular ring 11*c* and the midportion 11*b* and also at the central portion of the midportion. The midportion 11*b* has a number of slits therein. The rear ring 11*c* is fixedly connected to a front end of the rear axial sleeve 13. A small diameter portion 14 of the rear axial sleeve 13 is inserted into an inner peripheral rear end of a small diameter portion 3 of the front axial body 1 to thereby connect the two axial bodies to each other. Three holes 31 are formed equidistantly in the vicinity of the front end of the small diameter portion 3 of the front axial sleeve 1. Three balls 33 are retained at an associated concave portion 32 formed in the tightening member 8 through the respective holes 31 so that the outer surfaces of the balls are brought into contact with an inner surface of an annular concave portion formed in the front annular ring 11*a*.

An annular ring 35 is fixedly secured to an end of the chuck 7 and a spring $S_5$ is disposed between the ring 35 and an inner shouldered portion of the front portion of the rear small diameter portion 14 to thereby urge the chuck 7 backwardly. A lead casing 15 is enclosed in the rear axial body 13 and is biased to move backwardly by a spring $S_6$. A rod 37 is inserted through an axial through-hole 36 which is formed in the small diameter portion 14 of the rear axial sleeve 13. Front and rear ends of the rod 37 abut against the rear end of the tightening member 8 and the lead casing 15, respectively.

Since the three hinged portions are bent to be elongated when the depression member 11 is depressed, the tightening member 8 is advanced by action of the balls 33 and the tightening member 8 tightens the chuck 7. At this point, it is possible to further advance slightly the tightening member while the spring $S_5$ is compressed. When the push button 21 is pressed, the tightening member 8 is advanced through the lead casing 15 and the rod 37 to operate the chuck in the same manner.

In the embodiments shown in FIGS. 1 to 13, in order to retract the slider 5 into the mechanical pencil body, it is necessary to direct the tip end of the mechanical pencil body upward. However, in the eighth embodiment, the slider can be maintained in the retracted position by using an annular shaped retaining member 38 which is attached to the front axial body 1. The inner diameter of the retaining member 38 is slightly smaller than its outer diameter of the slider. The retaining member 38 is made of elastic material such as rubber and synthetic resin. When the slider is fully retracted into the mechanical pencil body, the slider 5 is retained by the retaining member 38. The slider 5 is released from the retainer 38 by depressing the depression member 11 or the pushbutton 21 thereby advancing the chuck 7 with the end of the chuck pushing the slider 5 forwards.

Figure 18:
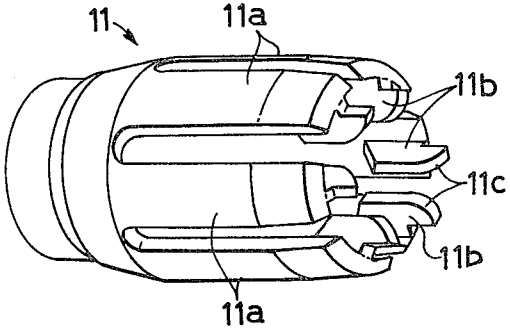
FIG. 18 is a perspective view of a depression member used in the ninth embodiment.
Figure 19:
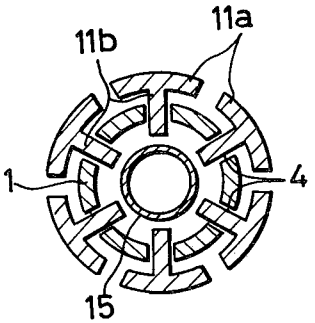
FIGS. 19 and 20 are cross-sectional views of the mechanical pencil shown in FIG. 17 taken along the lines XIX—XIX, and XX—XX, respectively.
Figure 17:
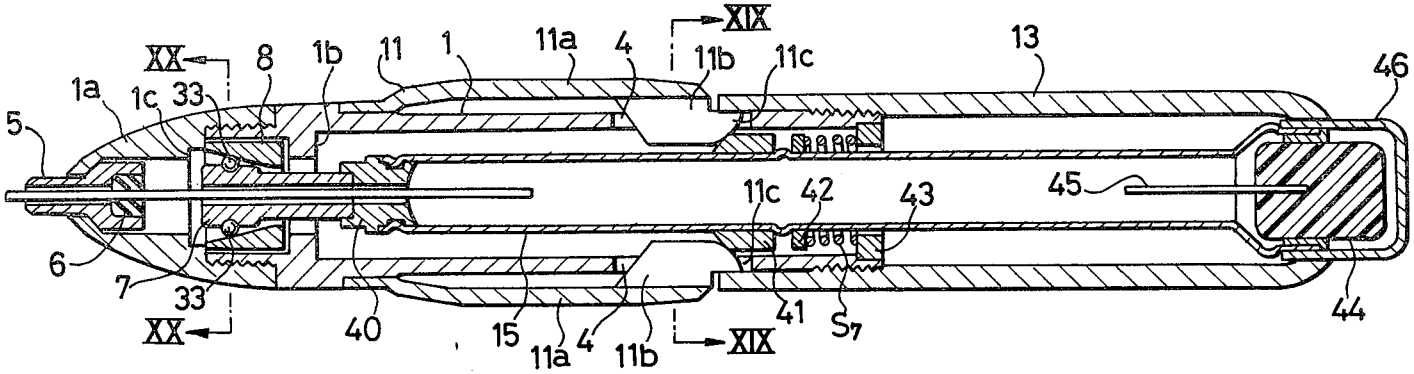
FIG. 17 is a cross-sectional view of a mechanical pencil of a ninth embodiment according to the present invention.

FIG. 17 shows a ninth embodiment of the present invention. A front axial body is formed by a front mouth body 1*a* and a sleeve member 1. A front portion of a depression member 11 is attached to the sleeve member 1. The depression member 11 is configured as shown in FIG. 18. The front part of the depression member 11 is formed in an integral manner while the rear part thereof is divided into a plurality of strips 11*a* rear end portions of which are each provided with respective projections 11*b*. Each of projections 11*b* has a cam surface 11*c* at its rear end. The strips 11*a* have a resiliency or elasticity such that when depressed inwardly, the strips are bent or curved inwardly, while when released, the strips 11*a* are restored to the original shape. In this specific embodiment, six slits 4 are formed at constant intervals in the rear part of the sleeve member 1 and the projections 11*b* are each received in the respective slits 4 as best shown in FIG. 19 in cross-section along line XIX—XIX of FIG. 17.

A slider 5 is slidably inserted into an opening of the mouth body 1*a* which is threadedly mounted on the sleeve member 1, so that a front pipe portion of the slider 5 can project from the opening of the mouth body. A lead holding member 6 is provided in the slider 5 in the same manner as in the preceding embodiments.

Figure 20:
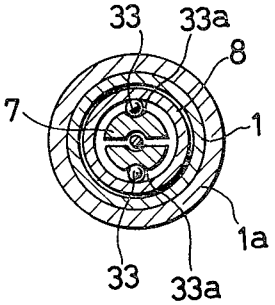

The lead tightening member 8 is received in the sleeve member 1 so as to be movable between an annular shouldered portion 1*b* of the sleeve member 1 and an annular shouldered portion 1*c* of the mouth body 1*a*. The chuck 7 is received in the tightening member 8. A pair of concave portions 33*a* are formed at the outer wall of the split chuck 7 and the balls 33 are retained in the concave portions 33*a* contacting the inner periphery of the tightening member 8 as best shown in FIG. 20 in cross-section taken along the line XX—XX of FIG. 17.

A lead casing 15 is connected to the rear end of the chuck 7 through a lead guide 40. An abutting ring 41 is secured on the outer periphery of the lead casing 15 and is positioned behind the projections 11*b* of the depression member 11. Another annular ring 42 is provided behind the ring 41 on the lead casing 15. A spring $S_7$ is disposed between the ring 41 and an annular ring 43 secured to the rear end of the sleeve member 1 to thereby impart a forward bias to the lead casing 15. A rear axial body 13 is threadedly connected to the rear part of the front sleeve member 1 so that the rear end portions of the projections 11*b* of the depression member 11 is supported by the front inner portion of the rear axial member 13. An eraser 44 having a cleaner pin 45 is slid into the rear end of the rear axial body 13 and is covered with a cap 46 projected rearwardly.

In operation, when no pressure is applied to the mechanical pencil, since the chuck 7 is advanced by the action of the spring $S_7$ through the lead casing 15 and is disengaged from the tightening member 8, the lead is not gripped by the chuck. If the mechanical pencil is carried with a cap member (not shown) having a clip for holding the pencil in a user's pocket and the mechanical pencil is covered at the tip end with the cap, in such a state, since the tip end of the mechanical pencil is directed upwardly, the slider 8 is dropped due to gravity together with the lead. Thus, the slider is automatically retracted into the mechanical pencil body.

Figure 21:
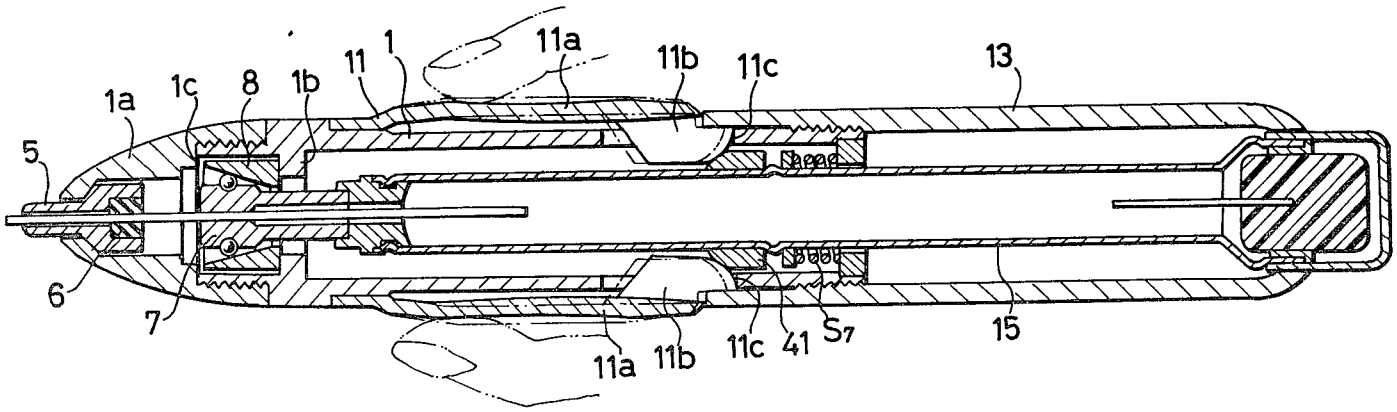
FIG. 21 is a cross-sectional views of the mechanical pencil of the ninth embodiment in another state.

In writing, the tip end of the pencil is of course directed downwardly and the lead and the slider 5 are advanced as shown in FIG. 17. In this state, when the depression member 11 is depressed by the finger shaped in a natural writing manner, the rear parts of the strips 11*a* are slightly depressed inwardly so that the cam surfaces of the projections 11*b* push the receiving ring 41 backwardly. Then, the spring $S_7$ is compressed to thereby move the chuck 7 backwardly through the lead casing 15. After the tightening member 8 is in abutment against the shouldered portion 1*b*, the chuck 7 is tightened by the tightening member 8 to grip the lead as shown in FIG. 21. When writing is continued in this state, the slider 8 is moved backwardly corresponding to the abrasion of the lead. It is possible to continue writing in this state until the slider is completely retracted into the pencil body. However, it is expected that the depression force applied to the depression member 11 will be intermittently released.

After the depression force is released, the strips 11*b* are expanded radially outwardly to return to their original shape. At this time, the lead casing 15 and chuck 7 are advanced due to gravity as well as by the action of the spring $S_7$. After the lead is released by the disengagement of the chuck 7 from the tightening member 8, the slider 5 is advanced together with the lead to return to the state shown in FIG. 17.

In case where the lead is not much worn down and the slider 5 is retained at the mouth body opening, when finger pressure is released from the depression member 11 and the chuck 7 is advanced, the lead is supplied from the tip of the slider 5 by the same distance that the tightening member is slid.

Writing may be continued while the depression member 11 is depressed, and the lead will be supplied to the tip end of the slider every time when the depression force is released.

Figure 22:
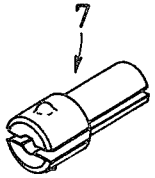
FIGS. 22 and 23 show modifications to an outer periphery of the chuck used in the ninth embodiment.
Figure 23:
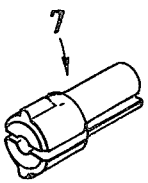

The balls 33 are disposed between the chuck 7 and the tightening member 8 in order to decrease the frictional force between the chuck 7 and the tightening member 8 enabling positive grip of the lead with the minimum possible force. Instead of the balls, it is possible to integrally provide hemispherical projections on the outer wall of the chuck as shown in FIG. 22 or projections each having thereon in semicircular shapes cross-section as shown in FIG. 23.

In the ninth embodiment, the spring $S_7$ may be dispensed with. Without the action of the spring $S_7$, the lead casing 15 and the like can be advanced by gravity when the depression pressure applied to the depression member 11 is released. In addition, the tightening member 8 may be fixed in order not to slide. In this case, the spring $S_7$ may be also dispensed with. When the depression member 11 is released, since the spring force of the chuck 7 urging it open is applied in addition to the force due to self-gravity to thereby further facilitate the advancing movement of the chuck 7.

Figure 24:
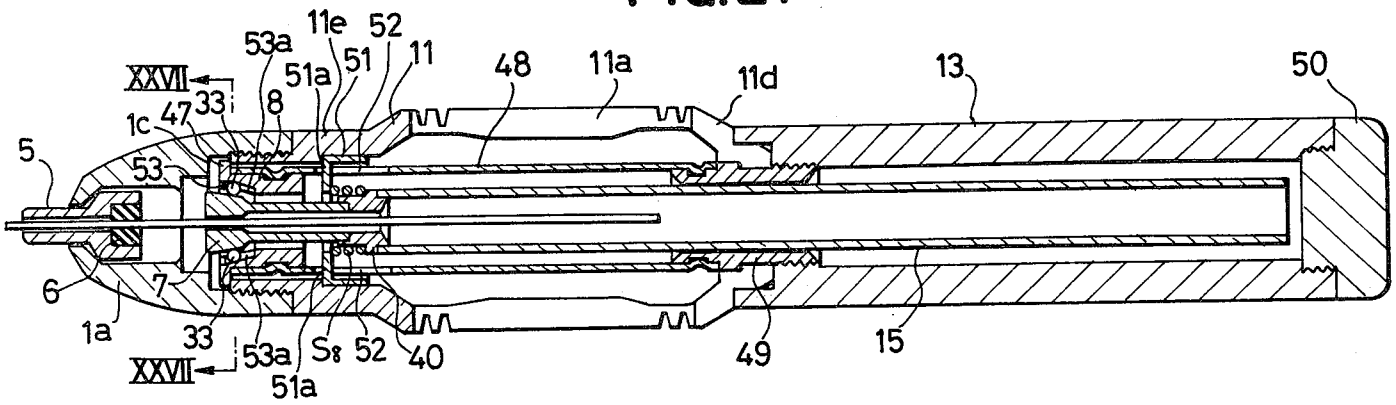
FIG. 24 is a cross-sectional view of a mechanical pencil of a tenth embodiment according to the present invention.
Figure 25:
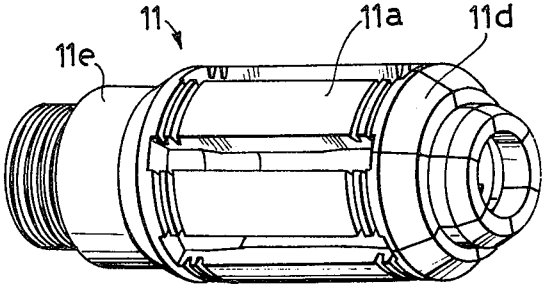
FIG. 25 is a perspective view of a depression member used in the tenth embodiment.

FIG. 24 shows a tenth embodiment of the present invention. The depression member 11 is, in this embodiment, formed so that the depression member 11 has a front annular ring part 11*e*, a plurality of depression parts divided into strips integral with the ring part 11*e* and divided rear parts 11*d*. As shown in FIG. 25, hinge parts are provided between the ring part 11*e* and depression part 11*a* and between the depression part 11*a* and rear parts 11*d*, respectively, so that the overall length of the depression member 11 can be shortened. The front part 11*e* is threadedly engaged with the mouth member 1*a* which receives the slider therein.

A flange 47 formed at the front end of the tightening member 8 is movable between a shouldered portion 1*c* and the front end of the depression member 11. The front end of a cylindrical sleeve 48 fixedly receives the tightening member 8 and the rear end of the cylindrical sleeve 48 is connected to the junction 49. The depression member 11 and the rear axial body 13 are connected to each other through the junction 49 so that the rear parts 11*d* of the depression member 11 is clamped between the junction and the front end portion of the axial body 13. A plug member 50 is threadedly inserted into the rear axial body 13 at its rear end.

Figure 27:
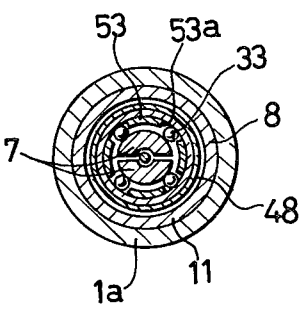
FIG. 27 is a cross-sectional view of the mechanical pencil taken along the line XXVII—XXVII of FIG. 24.
Figure 26:
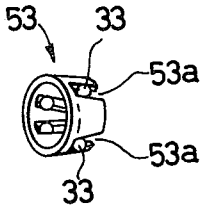
FIG. 26 is a perspective view of the balls and their receiver used in the tenth embodiment.

Projections 51*a* extending perpendicular from an annular ring 51 fixedly inserted into the front part 11*e* of the depression member 11 pass through slits 52 formed in the axial direction in the cylindrical sleeve 48. A spring $S_8$ is disposed between the projections 51*a* and the lead guide 40 fixedly connected to the rear end of the chuck 7. In the embodiment shown in FIG. 24, the spring $S_8$ is fully expanded. A ball retainer 53, as best shown in FIG. 26, has a plurality of slits 53*a* therein and the balls 33 are received in the slits 53*a*. The ball retainer 53 is generally received in the tightening member 8 in a fixed manner. As best shown in FIG. 27 in cross-section taken along line XXVII—XXVII of FIG. 24, the chuck 7 abuts against the balls 33.

As is clear from the above, the depression member 11 is depressed to thereby move backwardly the chuck 7 through the projections 51*a* and the spring $S_8$. The operation of this embodiment is substantially the same as that of the fifth embodiment.

As mentioned above, various lead supplying techniques are included in the various embodiments of the present invention. All the embodiments of the present invention will be classified into the following three types according to the lead supplying methods. First, a technique wherein the chuck simply grips the lead when the depression member is depressed it utilized in the third, fourth, seventh and ninth embodiments. Secondly, a technique wherein when the depression member is depressed, the chuck grips the lead and while in this state the depression member is further depressed, and the chuck is further advanced while the lead being gripped by the chuck to provide a new lead from the tip end of the slider is included in the first, second, fifth, sixth, eighth and tenth embodiments. Among these embodiments, the embodiments in which the pushbutton-type lead supplying mechanism is not used are only the sixth and tenth embodiments. Thirdly, a technique in which when the pushbutton is depressed the lead is gripped by the chuck 7 and a new lead is supplied from the tip end of the slider when the pushbutton is further depressed forms part of the first, second, fifth and eighth embodiments. In the ninth embodiment, the lead is extended by the pushbutton in which the tightening member 8 is moved fore-and-aft a short distance.

Various embodiments of the invention have been heretofore described. Many various or modifications can be made by combining features of the various embodiment of the invention. It is common among all embodiments of the invention that the tightening member or the pushing member and/or the chuck may be moved by the depression of the depression member provided at a natural gripping position of the mechanical pencil. Various materials and shapes may be used for the depression member. It is effective to apply a lever-principle to the depression member for readily moving the tightening member, the pushing member or chuck using a slight depression pressure. Knurls may be formed on the depression member for the purpose of enhancing the frictional force between the knurled surface and the writer's fingers. It is possible to use a thin cylindrical sleeve made of rubber on the depression member for the same purpose.

In order to rapidly return the slider to the fully advanced position when the depression force applied to the depression member is released to disengage the lead, the slider may be pushed forwardly with a spring. For this purpose, the drawing or separating action of a permanent magnet may be used.

In such embodiments, the depression member per se has a returning resilient or deformable force. However, it is possible to use a depression member having no returning force if an independent spring member is provided.

Many techniques for retaining the slider in the mouth member may be used in addition to that used in the eighth embodiment. For example, alternatively, the retaining member may be fixed to the slider and frictionally engaged with the inner surface of the mouth member to hold the slider in the mouth member. Suitable shapes and materials may be used for the retaining member.

The constructions and operations according to the present invention have been described. The resultant effects will be described in addition.

In the mechanical pencil according to the present invention, when the tip of the mechanical pencil is directed downwardly for the purpose of writing, or when the slider is moved by the chuck, to disengage the retaining member, the slider is advanced together with the lead to a position where writing is possible. Then, when the depression member is depressed, the tightening or pushing member, and/or the chuck are advanced to grip the chuck by the tightening member, the lead being gripped by the chuck so that continuous writing is possible. Though the slider is moved backwardly as the lead is worn down, when the depression of the depression member is released in writing for the purpose of relaxing the writer's fingers, the depression member is restored to the original shape to thereby disengage the chuck and the tightening member. At this time, the slider is automatically advanced to thereby supply the mechanical pencil tip with a new lead. During writing, the above described successive operations are repeated.

The lead is automatically provided utilizing the natural writing operation in which the mechanical pencil body is gripped or loosened during writing. That is, it is according to the present invention possible to obtain substantially the same effect as a completely automatic mechanism pencil. Therefore, in comparison with prior art mechanical pencils, the handling of a mechanical pencil according to the invention is extremely easy without any need for applying an unnatural force thereto or to abut a tip thereof against a paper surface.

What is claimed is:

1. A mechanical pencil comprising:

a hollow pencil body including a front axial sleeve having a generally conically shaped portion and a rear axial sleeve having a generally cylindrical shape;

a chuck disposed within said pencil body and having a resiliency urging said chuck to open outwardly at a front end thereof, said chuck gripping a lead when tightened;

a slider including a lead holding member for lightly holding the lead, said slider being slidable at a tip of said front axial sleeve and said slider including a shouldered portion positioned within the front axial sleeve for limiting a range of movement of said slider;

a generally cylindrical resilient depression member, one end of said depression member being fixed to a portion of said pencil body, said depression member being positioned at a position of the body normally in contact with the writer's fingers during writing with said pencil;

means for transmitting movement due to deformation of said depression member to said chuck, the deformation of said depression member causing tightening of said chuck about said lead;

lead casing means disposed in said rear axial sleeve;

said lead casing means comprising a cylindrical lead casing rigidly coupled to a rear end of said chuck and further comprising a spring for rearwardly biasing said chuck and casing, and said means for transmitting movement comprising a first chuck tightening member surrounding at least a portion of said chuck and a ring member in contact with said tightening member secured to a rear free end portion of said depression member with a front end portion of said tightening member contacting a front outer slanted portion of said chuck so as to transmit movement of said depression member due to its deformation to said chuck whereby said chuck tightening member is advanced to positively grip the chuck; and an additional lead feeding mechanism, said additional lead feeding mechanism comprising a pushbutton extending outwardly axially from a rear end of said rear axial sleeve for manual depression and a longitudinal rod in contact at one end thereof with the rear end of said chuck tightening member and at the other end thereof with said pushbutton.

* * * * *